US006531948B1

(12) United States Patent
Mennell

(10) Patent No.: US 6,531,948 B1
(45) Date of Patent: Mar. 11, 2003

(54) FUSE HANDLER

(75) Inventor: Thomas W. Mennell, North Yorkshire (GB)

(73) Assignee: Schneider Electric Limited, North Yorkshire (GB)

( * ) Notice: Subject to any disclaimer, the term of this patent is extended or adjusted under 35 U.S.C. 154(b) by 0 days.

(21) Appl. No.: 09/856,427

(22) PCT Filed: Nov. 25, 1999

(86) PCT No.: PCT/GB99/03915

§ 371 (c)(1),
(2), (4) Date: Jun. 16, 2001

(87) PCT Pub. No.: WO00/33342

PCT Pub. Date: Jun. 8, 2000

(30) Foreign Application Priority Data

Nov. 27, 1998 (GB) ..... 9825900

(51) Int. Cl.[7] ..... H01H 85/56; H01H 85/60; B25B 27/00

(52) U.S. Cl. ..... 337/211; 337/168; 337/216; 337/208; 337/284; 81/3.8

(58) Field of Search ..... 337/158, 211, 337/208, 212, 213, 216, 284, 168; 81/3.8

(56) References Cited

U.S. PATENT DOCUMENTS

| | | | | | |
|---|---|---|---|---|---|
| 1,966,716 | A | * | 7/1934 | Green | 337/188 |
| 2,004,328 | A | * | 6/1935 | Johansson | 337/139 |
| 2,030,506 | A | * | 2/1936 | Driescher | 337/211 |
| 2,243,528 | A | * | 5/1941 | Grinnell | 29/278 |
| 2,275,903 | A | * | 3/1942 | Hermann | 294/19.1 |
| 2,313,364 | A | * | 3/1943 | Schultz | 337/195 |
| 2,379,433 | A | * | 7/1945 | Hemmerling | 29/273 |
| 2,949,517 | A | * | 8/1960 | McBride | 337/212 |
| 3,202,788 | A | * | 8/1965 | George | 337/194 |
| 3,406,365 | A | * | 10/1968 | Lameyre | 337/10 |
| 3,418,615 | A | * | 12/1968 | Canney | 337/190 |
| 3,518,599 | A | * | 6/1970 | Lanux | 337/186 |
| 3,813,626 | A | * | 5/1974 | Cetola et al. | 174/138 F |
| 4,696,528 | A | * | 9/1987 | Harnois | 439/160 |
| 4,777,559 | A | * | 10/1988 | Bar et al. | 200/50.27 |
| 4,966,561 | A | * | 10/1990 | Norden | 337/211 |
| 5,076,118 | A | * | 12/1991 | Lawson | 81/3.8 |
| 5,406,449 | A | * | 4/1995 | Hicks et al. | 200/304 |
| 5,800,043 | A | * | 9/1998 | Walkerow | 362/119 |
| 5,969,587 | A | * | 10/1999 | Combas | 335/132 |
| 5,973,418 | A | * | 10/1999 | Ciesielka et al. | 307/112 |
| 6,448,785 | B1 | * | 9/2002 | Rohmer et al. | 324/550 |
| 2002/0067240 | A1 | * | 6/2002 | Darr et al. | 337/187 |

FOREIGN PATENT DOCUMENTS

| | | | | |
|---|---|---|---|---|
| CH | 504 097 | | 2/1971 | |
| DE | 1 806 152 | | 5/1970 | |
| EP | 0 127 298 | | 12/1984 | |
| GB | 1 485 002 | | 9/1977 | |
| JP | 11260237 | A * | 9/1999 | H01H/85/02 |
| JP | 2000340095 | A * | 12/2000 | H01H/58/02 |

* cited by examiner

*Primary Examiner*—Anatoly Vortman
(74) *Attorney, Agent, or Firm*—Merchant & Gould P.C.

(57) ABSTRACT

A fuse handling device for use with a fuse unit having a pair of contacts between which a fuse terminals which act as switching contacts may extend in use. The handling device comprises an actuating lever operable into a first position and a second position, a charging means operably connected to the actuating lever and a drive means operably connected to the charging means. The handling device in use is mounted on the fuse unit. The drive means attaches to the fuse and operation of the actuating lever into the first position charges the charging means to causes the drive means to extract the fuse from the pair of contacts and operation of the actuating lever into the second position charges the charging means to cause the drive means to insert the fuse into the pair of contacts. The fuse moves in a direction parallel to a plane of its switching contacts.

24 Claims, 14 Drawing Sheets

FUSE HANDLER

BACKGROUND OF THE INVENTION

The present invention relates to a device for handling fuses and in particular, but not exclusively, to a device for safety inserting and extracting electrical fuses used in a three phase electrical fuse unit.

Fuse units are used in low voltage distribution and supply networks. Low voltage supply distribution from indoor and outdoor sub-stations include a fuse board, fuse pillar or fuse cabinet, incorporating a fuse unit, as part of the network and as appropriate to the particular application. Conventionally, four or five supply bus bars are provided, one for each of the three phases and either a common earth neutral bar or separate earth and neutral bars. Each three phase output taken from the supply has each power carrying cable connected to the bus bar of the respective phase by way of a fuse, the three fuses being mounted together in a fuse unit on a distribution unit. Each fuse is designed to engage and bridge a pair of contacts, one electrically connected to the respective bus bar, and the other to the respective output.

Two different types of fuse are used in such applications: UK style fuses with additional contact members and European style fuses. UK and European style fuses differ in their geometry and the contact members that they present to the pair of contacts in the fuse unit. UK style fuses have additional contact members providing a generally U shaped configuration and tend to be presented to contacts in a fuse holder in an inverted U manner with the contact members providing the legs of the U which engage the pair of contacts of the fuse holder. The legs of the U extend laterally to provide an extended region of contact between the fuse contact members and the fuse holder contacts adapted to receive them. European style fuses have fuse terminals providing integral flat planar contact members extending from either end of a main body and are inserted vertically into fuse unit contacts adapted to receive them.

In order to handle the supplied electrical currents and to provide good electrical and mechanical contact, the contact members of a European fuse are extended vertically. In contrast the contact members of UK style fuses extend laterally.

In order to allow for the safe handling of live fuses they must be rapidly and firmly inserted or removed form the live contacts. Owing to the U shaped configuration of UK style fuses this can be achieved quite readily. However, owing to the fact that European style fuses extend substantially further in the direction of their insertion or removal a greater stroke is required in order to safely effect their removal or insertion. European style fuses are becoming prevalent in a number of countries and the safety requirements for their handling are becoming more stringent. Hence there is a need for a device for effecting the safe handling of European style configured fuses in live fuse units.

European style configured fuse handling devices integral to a fuse unit can be provided but at increased cost and complexity to the fuse unit. A removable device suitable for use with a fuse unit allows the safe handling of all live fuses by a single device providing economies of cost and simplicity of fuse unit manufacture. A compact handling device is to be preferred, owing to the proximity of fuse units on fuse boards, pillars or cabinets and their ease of use by workmen.

SUMMARY OF THE INVENTION

According to a first aspect of the invention there is provided a fuse handling device for use with a fuse unit having a pair of contacts between which a fuse with integral switching contacts may extend in use, the handling device having an actuating lever operable into a first position and a second position, a charging means operably connected to the actuating lever and a drive means operably connected to the charging means, in which when the handling device in use is mounted on the fuse unit, the drive means attaches to the fuse and operation of the actuating lever into the first position charges the charging means to causes the drive means to extract the fuse from the pair of contacts and operation of the actuating lever into the second position charges the charging means to cause the drive means to insert the fuse into the pair of contacts, in which the fuse moves in a direction parallel to a plane defined by its switching contacts.

The device is for use in safely extracting and inserting European style configured fuses as used in fuse units. Both a European style fuse and a UK fuse without additional contact members, i.e. with integral fuse terminal/switching contacts, are considered to fall within the scope of a European style configured fuse. The invention allows fuses with integral switching contacts to be safely manipulated while the fuse unit is still live. The handling device is actuated by a throw lever. With the actuating lever in a first neutral position the device is mounted on a fuse unit and a drive means attaches to a fuse located between a pair of contacts in the fuse unit. Operation of the actuating lever into a first position charges up a charging means until sufficient energy has been stored to effect rapid and safe removal of the fuse from its pair of contacts. The device can also be used to safely insert a fuse between a pair of live contacts. The device with a fuse can be mounted on the live fuse unit and the actuating lever operated into a second position. Charging means are charged until sufficient energy is stored to effect the rapid and safe insertion of the fuse between a pair of contacts in the fuse unit. The device can move the fuse in a plane substantially parallel to the plane defined by the switching contacts of a European style configured fuse.

Preferably, the device has a housing and an axle extending across the housing and the actuating lever pivots about the axle. The provision of a housing improves the safety of the device and also provides a robust device capable of withstanding the mechanical forces exerted during extraction and insertion of a fuse.

The drive means of the device may include a member having a fuse engagement formation slidingly mounted on the device. The fuse engagement formation of the member securely attaches the fuse to the drive means for either insertion or extraction. Slidingly mounting the member on the device helps to robustly guide the motion of the fuse during extraction or insertion ensuring the fuse moves along a preferred path.

Preferably, the member slides in a direction parallel to a plank defined by the pair of contacts of the fuse unit. In this way frictional forces between the pair of contacts and the fuse are minimised and the fuse moves through the minimal possible distance thereby increasing the efficiency of the insertion of extraction of the fuse.

The charging means may include a pair of springs. The charging means may include two pairs of springs. Preferably, the springs of a pair of springs are wound in opposite senses.

An outer end of the first spring of the pair may be connected to the actuating lever and an outer end of the second spring of the pair may be connected to the drive means and the inner ends of the first and second springs are connected in series. This provides for charging the springs to a predetermined amount before they discharge to extract or insert the fuse. The predetermined amount should be sufficient to safely extract or insert a fuse in a live fuse unit.

Preferably the pair of springs are mounted concentric to the axle. In this manner the springs can be easily and simply operably connected to the actuating lever. The pair of springs may be connected in series via a square shaft mounted concentric to the axle.

Preferably a motion transformation device is mounted on the axle and engages the drive means. The motion transformation device can include members arranged to convert rotational motion to linear motion. The motion transformation device is preferably in the form of an arm which may be pivotally mounted on the axle and engage the drive means. In this way the rotational movement of the actuating lever and charging means may be transformed into linear movement of the drive means such that the fuse may be extracted or inserted sufficiently quickly so as to be achieved safely.

The housing of the device may have locating formations which when the device is in use co-operate with the fuse unit to locate the device. The locating formations ensure the correct registration of the device with respect to the fuse unit so that the fuse is extracted or inserted correctly and safely and also help prevent relative movement of the device and fuse unit during operation of the device.

According to a second aspect of the invention there is provided a fuse assembly having a fuse unit having a pair of contacts between which a fuse with integral switching contacts may extend in use and a fuse handling device having an actuating lever operable between a first position and a second position, a charging means operably connected to the actuating lever and a drive means operably connected to the charging means, in which when the handling device in use is mounted on the fuse unit, the drive means attaches to the fuse and operation of the actuating lever into the first position charges the charging means to cause the drive means to extract the fuse from the pair of contacts and operation of the actuating lever into the second position charges the charging to cause the drive means to insert the fuse into the pair of contacts, in which the fuse moves in a direction parallel to a plane of the switching contacts of the fuse.

The fuse unit may have three pairs of contacts between each of which a fuse with integral switching contacts may extend in use. In this way the assembly allows for the safe handling of European style configured fuses in a fuse unit handling a three-phase electrical supply.

Preferably, the pair of contacts define a plane and the device in use moves the fuse substantially parallel to the plane. In this way the safe extraction or insertion of the fuse is improved as the fuse is caused to move straight in or out of the contacts, reducing friction and electrical arcing.

The use assembly can include a fuse carrier interlock mechanism, the fuse having a carrier bearing an interlock formation on a side thereof, the fuse unit including an interlock mechanism including a projection directed toward the interlock formation, and engageable therewith to prevent motion of the fuse carrier relative to the fuse unit, and the handling device including an interlock actuating member which, in use, operates the interlock mechanism to disengage the projection and interlock formation so as to allow the fuse carrier to be extracted from or inserted into the fuse unit. In this way the fuse carrier is prevented from being removed from or inserted into the fuse unit without operation of the interlock mechanism.

A fuse handling device as claimed in claim 1 including a handling device interlock and for use with a fuse unit including a rear and a forward locating formation, the handling device including a notch engageable with the rear locating formation and a recess engageable with the forward locating formation, to allow the handling device to be slidably mounted on the fuse unit, and an interlock formation movable relative to the handling device and including a limb which when the forward locating formation is engaged in the recess is positionable between the rear and forward locating formations, to prevent relative sliding motion of the handling device and fuse unit thereby locking the handling device to the fuse unit. In this way registration of the handling device and fuse unit is ensured prior to operation of the device.

Preferably, the handling device includes an interlock lever on which the interlock formation is mounted so as to be movable between a locked and an unlocked position. More preferably, the interlock lever includes a part engageable with a part of the actuating lever to prevent operation of the actuating lever unless the interlock lever is in its locked position. In this way, the handling device is prevented from being mounted on or removed from the fuse unit, unless the handling device is in a non-operating configuration. Most preferably, the interlock lever part is a notch and the actuating lever part is a member extending parallel to the pivot axis of the actuating lever.

The fuse handling device can include a locking mechanism for use with a fuse carrier having a fuse carrier locking formation, the handling device including a pivotable arm with a notch at a free end which in use is engageable with the fuse carrier locking formation so as to selectively lock the fuse carrier to the fuse handling device, a cam drivable by the actuating lever and acting on the pivotable arm such that when the actuating lever is in a neutral position, the arm cannot pivot thereby locking the fuse carrier to the fuse handler. In this way, the fuse carrier is safely locked in the handling device prior to insertion or after removal from the fuse unit.

The fuse handling device can include resilient biassing means which biases the pivotable arm into a locking position.

The cam can include a first part and a second part which when driven by the actuating lever to act on the pivotable arm allow the arm to pivot thereby allowing engagement or disengagement of the notch and locking formation.

BRIEF DESCRIPTION OF THE DRAWINGS

The present invention will now be described, by way of example only, with reference to the accompanying drawings, in which.

Figure 1A:
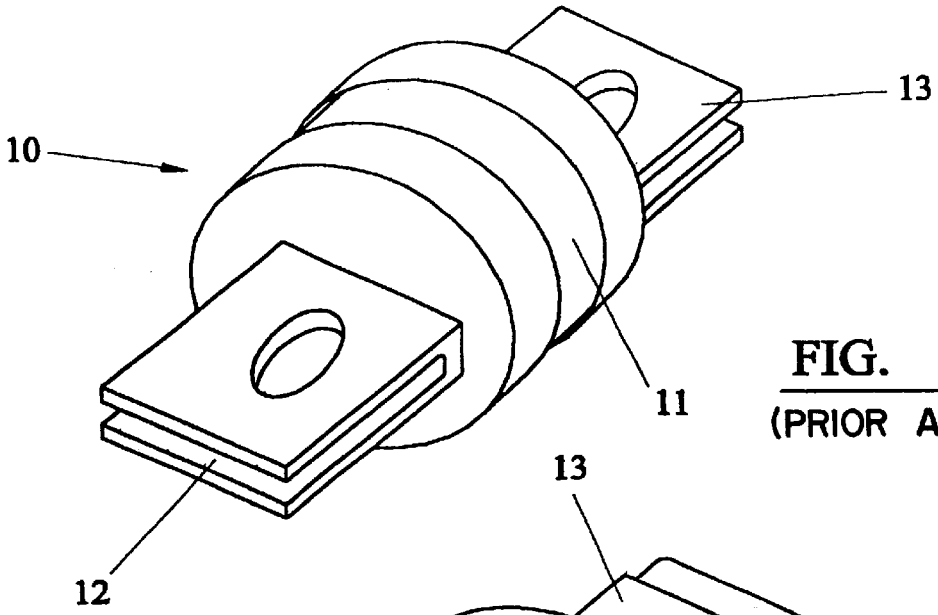
FIG. 1a (PRIOR ART)
FIGS. 1*a* and 1*b* show respectively schematic perspective views of a UK style fuse and a UK style fuse incorporating separate switching contacts.

The same items in different Figures share common reference numerals.

DETAILED DESCRIPTION OF THE PREFERRED EMBODIMENT

Figure 1B:
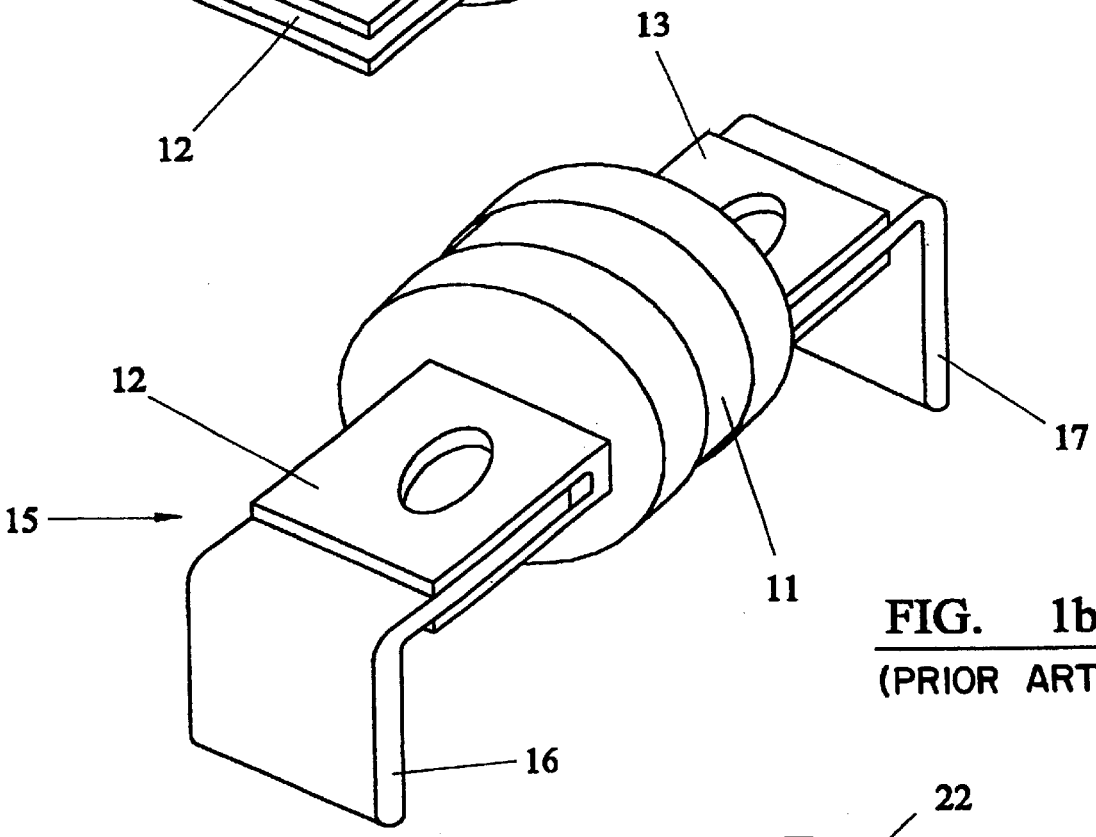
FIG. 1b (PRIOR ART)
Figure 2:
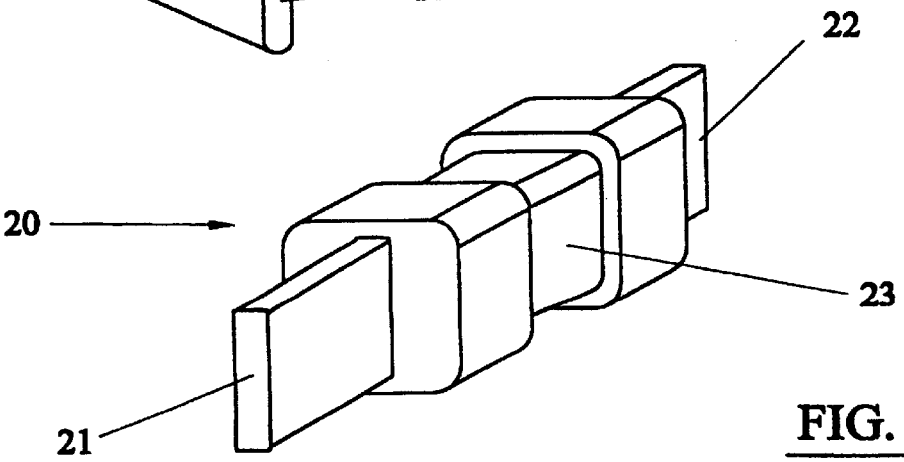
FIG. 2 (PRIOR ART)
FIG. 2 shows a schematic perspective view of a European style fuse.

With reference to FIGS. 1*a*, 1*b* and 2 there are shown respectively schematic perspective views of a UK style fuse, designated generally by reference numeral 10, a UK style fuse with ancillary switching contacts, designated generally by reference numeral 15 and a European style fuse, designated generally by reference numeral 20. The UK style fuse, 10, has a fuse barrel 11 from which fuse terminals 12, 13 extend. Such terminals can be a single tab or as shown in FIG. 1*a* may be U-shaped. Previously, in order to use UK style fuses in a switchable fuse unit, an ancillary switching contact 16, 17 is bolted or otherwise connected to the integral fuse terminals 12, 13 as shown in FIG. 1*b*. This results in a generally U-shaped fuse composite. A European style fuse 20 has a generally planar configuration with a first planar fuse terminal 21 and a second planar fuse terminal 22 extending from a fuse barrel 23. The fuse terminals which extend from the fuse body can be used as switching contacts therefore there is no need for ancillary switching contacts as used with K style fuses. The European style fuse thus has an integral fuse terminal which can be used as a switching contact. Similarly the UK style fuse 10 has fuse terminals which can act as switching contacts and so has integral switching contacts and a fuse configuration similar to that of a European style fuse.

This specific example describes the invention with regard to a European style fuse only. It will be appreciated that a UK style fuse with integral switching contacts, i.e. without ancillary switching contacts, and hence having a configuration similar to that of a European style fuse can be substituted for the European style fuse with a corresponding alteration to the contacts used in the switch unit.

Figures 3A, 3B, 3C:
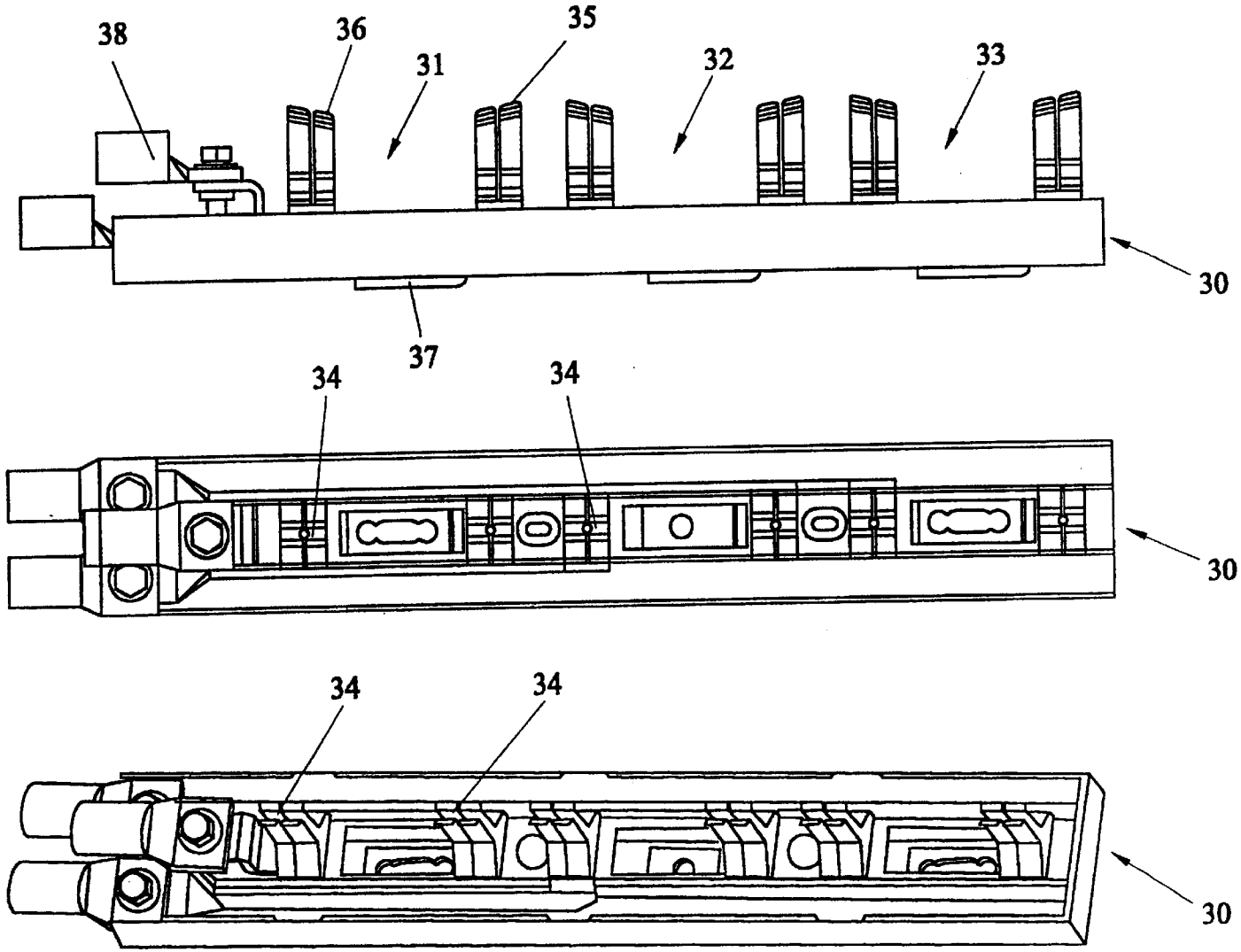
FIGS. 3*a*, 3*b* & 3*c* show side, top and perspective views respectively of a sub-assembly of a fuse unit being part of a fuse assembly according to an aspect of the invention.

With reference to FIGS. 3*a*, 3*b* & 3*c* there are shown side, plan and perspective views respectively of a sub-assembly part of a fuse unit, 30. The sub-assembly has three pairs of contacts 31, 32, 33 suitable for accepting European style fuses. (In the case of a UK style fuse with integral switching contacts the fuse unit pairs of contacts would need adapting correspondingly.) Each contact has an opening 34 for engaging a contact member of a European style fuse bridging the pair of contacts. A first of each pair of contacts 35 is electrically connected to a bar 37 to which a phase of a three phase electrical supply may be contacted. The other contact of each pair of contacts 36 is electrically connected to an output supply for the one of the three phases 38. When bridging the pair of contacts the European style fuse completes the circuit for that one of the three phases handled by the fuse unit. The pairs of contacts between them define a plane parallel to which a fuse moves during insertion or removal.

Figure 4A:
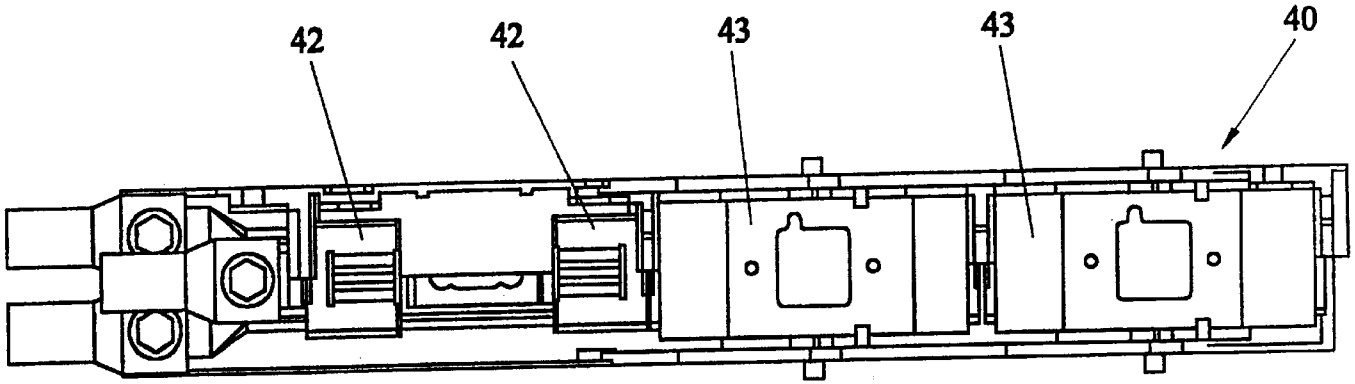
FIGS. 4*a*, 4*b* & 4*c* show top, side and perspective cut away views of European style fuses in use with a fuse unit being part of a fuse assembly according to an aspect of the invention.
Figure 4B:
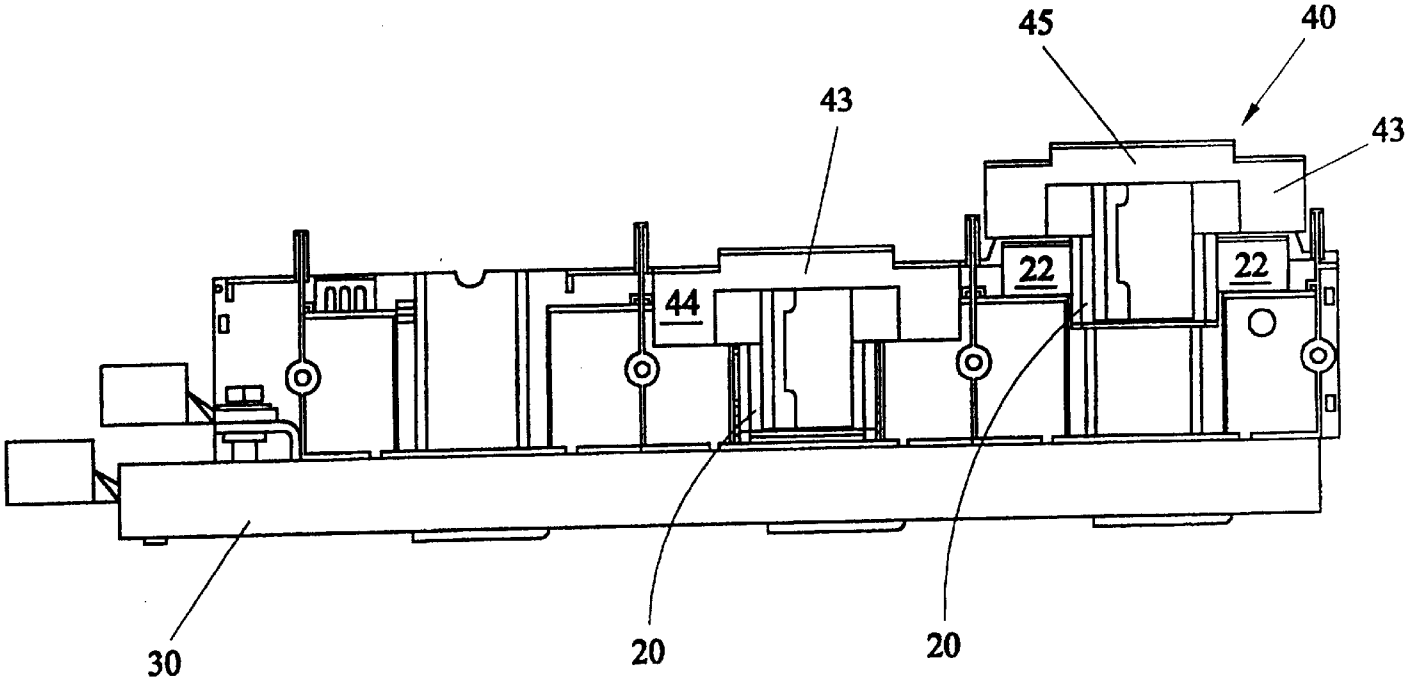
Figure 4C:
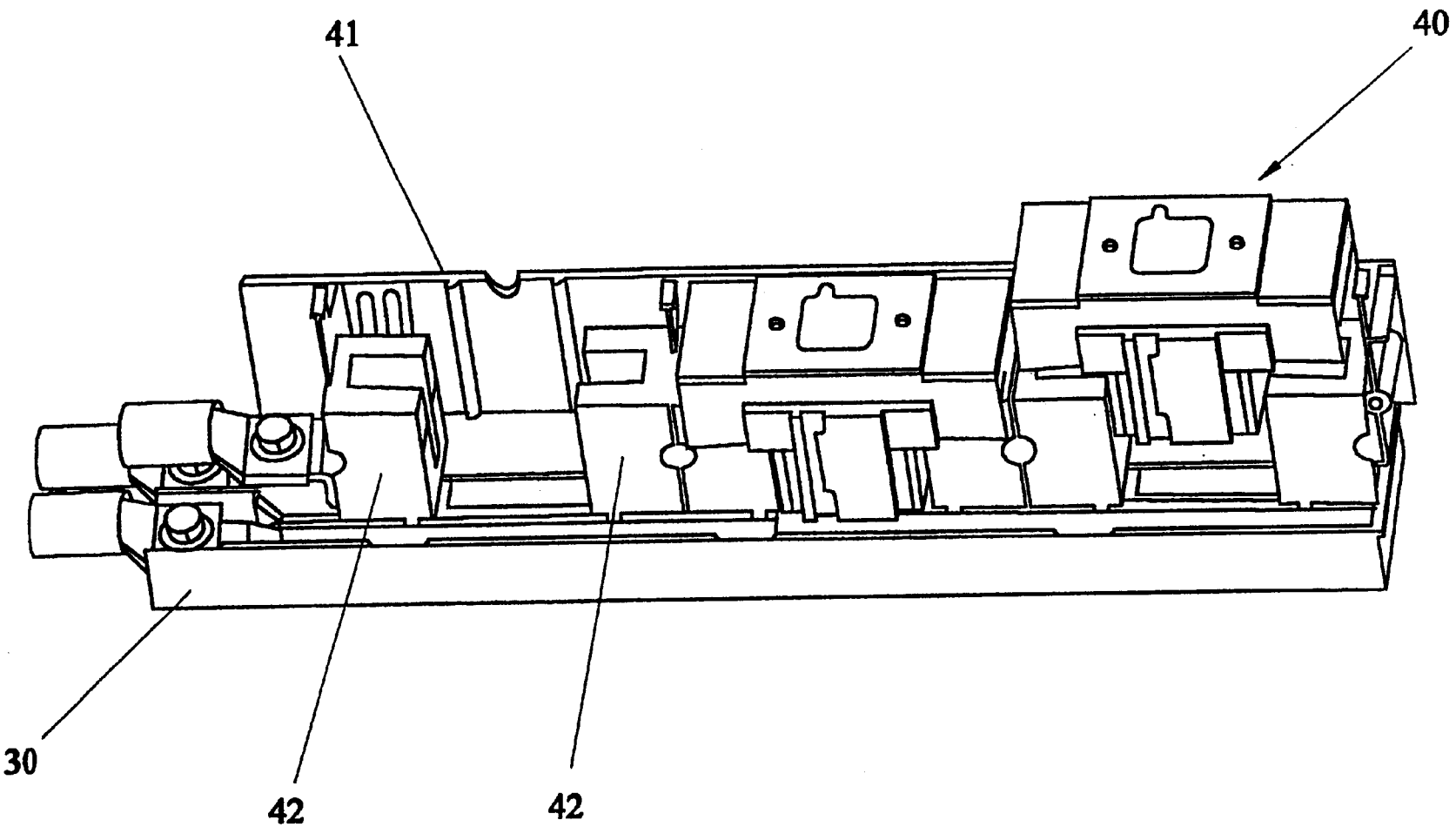

With reference to FIGS. 4*a*, 4*b* & 4*c* there are shown cut away plan, side and perspective views respectively of a fuse unit part of an assembly according to an aspect of the invention, designated generally by reference numeral 40. The fuse unit includes the sub-assembly 30 as described previously and has a fuse unit housing 41. The fuse unit includes arcing suppressing devices 42 mounted around the contacts of the pairs of contacts. A European style fuse 20 is provided in a fuse holder 43. The fuse holder 43, arcing suppressing devices, and fuse unit housing are all adapted to allow European style fuses to be inserted in and removed from the fuse unit by slidingly engaging the fuse contacts 21 and 22 in the contacts 35, 36 of a respective pair of contacts of the fuse unit. Fuse holder 44 holds a European style fuse fully inserted in the fuse unit and fuse holder 45 holds a European style fuse extracted from the fuse unit, in the sense that the fuse no longer bridges its respective pair of contacts.

Figure 5A:
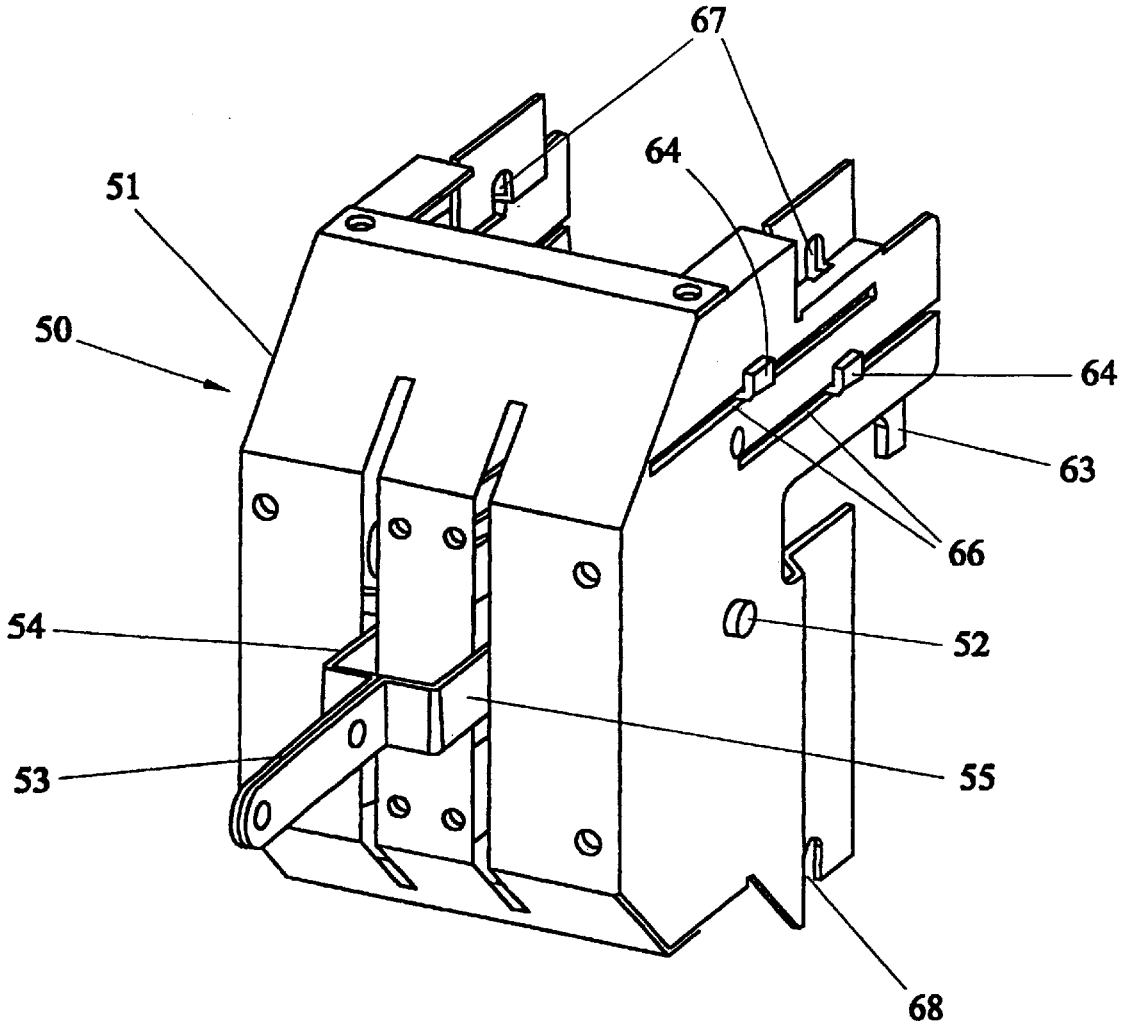
FIGS. 5*a*, 5*b* show perspective views from above and below respectively of a fuse handling device according to an aspect of the invention.
Figure 5B:
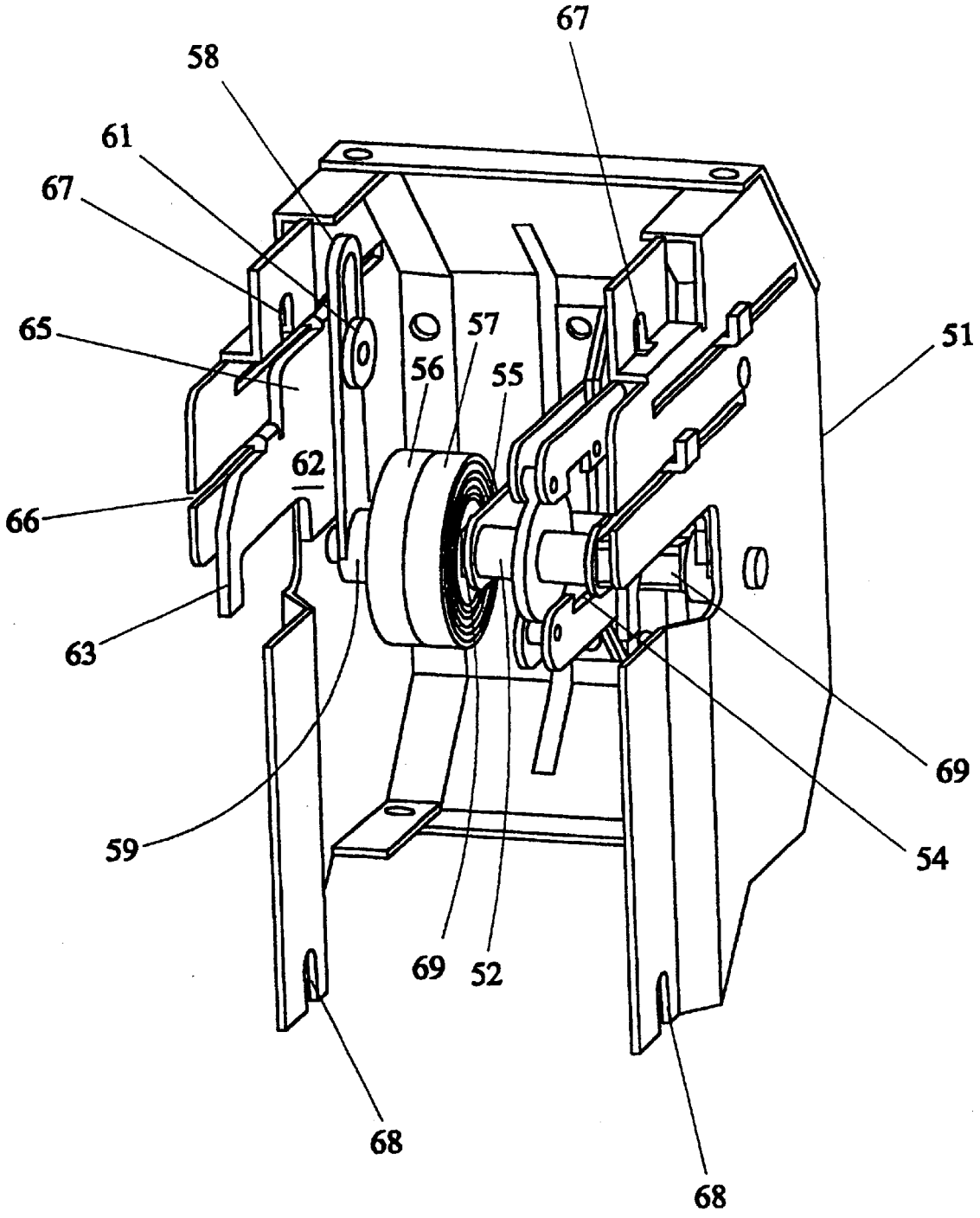

With reference to FIGS. 5*a* and 5*b* there are shown perspective views from above and below respective of a fuse handling device according to an aspect of the invention, designated generally by reference numeral 50. The device comprises a housing 51 across which an axle 52 extends. An actuating lever 53 is operably connected to the axle by a pair of legs 54, 55. The actuating lever is shown in a neutral position with respect to the housing. The actuating lever may pivot about the axle into a first position and a second position as will be described later. Charging means are provided in the form of a pair of springs 56, 57 mounted concentrically to the axle and operably connected to the actuating lever. The springs of the pair of springs are wound in opposite senses.

A first of the pair of springs 56 has an outer end connected to the actuating lever. A square shaft 69 is mounted concentrically to the main axle 52 and the pair of springs are mounted over the square shaft. An inner end of the first spring 56 is attached to the square shaft. An inner end of the second spring 57, wound in the opposite sense to the first spring, is also attached to the square shaft such that the pair of springs are connected effectively in series. An outer end of the second spring is attached to a collar 59 mounted on the main axle and forming part of the drive means as is now described. A second pair of oppositely wound springs (not shown) can be mounted on a second square shaft 69 on the opposite end of the main axle 52 so as to enhance the capacity to store energy prior to actuation of the drive means.

The drive means 65 provided includes a means of converting rotational motion into linear motion in the form of an arm 58 attached to a collar 59 mounted concentrically to the axle and pivoting about it. An aperture 60 is provided in the end of the arm in which a slider 61 runs. The slider is connected to a planar member 62 having a fuse engagement formation 63 at an exposed end. The member 62 has sliding formations 64 which engage slide ways 66 in the housing 51 to guide the motion of the member. Similar drive means may be provided at the opposite side of the housing which work in co-operation with the second pair of springs of the charging means. Locating formations are provided 67, 68 at each corner of the housing to ensure correct registration of the device in use as will be described later.

The actuating lever 53 is operably connected to the first of the pair of springs 56, 57. The arrangement of the oppositely wound springs connected in series causes the springs to charge to a predetermined extent, before the springs cause the arm 58 to pivot thereby activating the drive means, causing the member to slide into or out of the housing depending on the direction in which the lever is operated.

Operating the lever into a first position by pushing it in an upwards direction as shown in FIG. 5*a* causes the springs to charge to a predetermined extent. Once the springs have charged to this extent, the springs release energy driving the collar 59, causing arm 58 to pivot into the housing. Slider 61 runs in the recess in the arm and causes the member 62 to be withdrawn into the housing. The actuating lever can then be returned to the neutral position as shown in FIGS. 5*a* and *b*. Operating the lever in the opposite direction again causes the springs to charge to a predetermined extent before discharging the stored energy to driving the collar 59 such that arm 58 pivots thereby slidably driving member 62 out of the housing. The predetermined extent of charging of the springs should be sufficient that a European style fuse can be sufficiently rapidly and firmly moved into or out of engagement with a pair of contacts of a fuse unit in a safe manner.

Figure 6A:
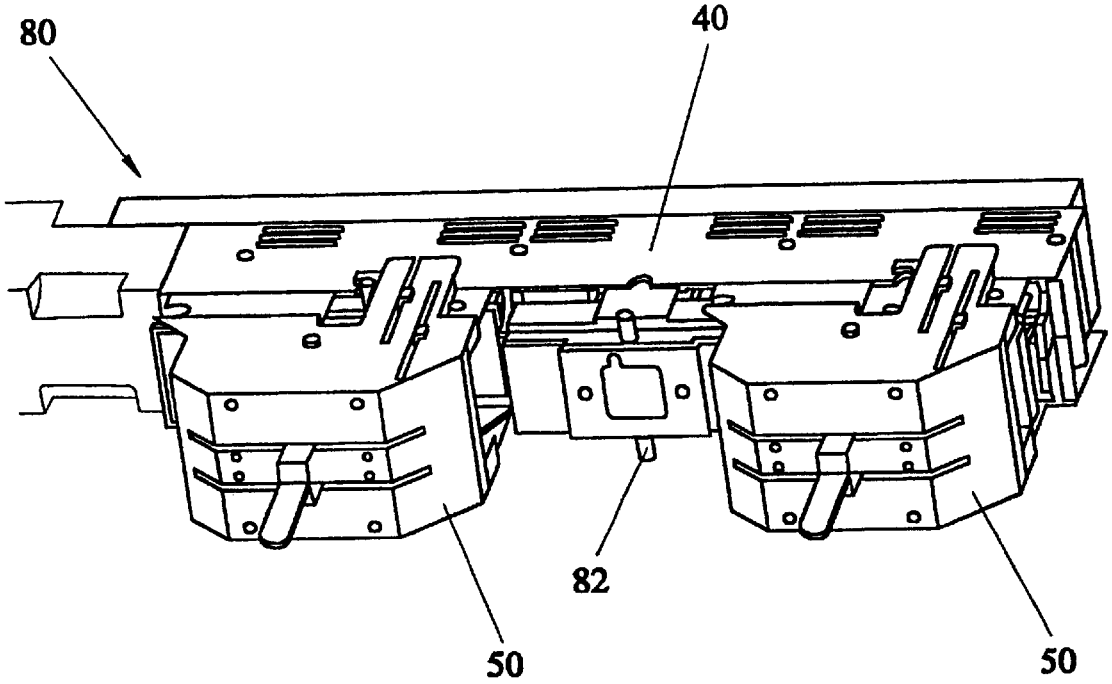
FIGS. 6*a*, 6*b* & 6*c* show perspective, side and plan views respectively of a fuse assembly according to an aspect of the invention comprising a fuse handling device according to an aspect of the invention mounted on a fuse unit.
Figure 6B:
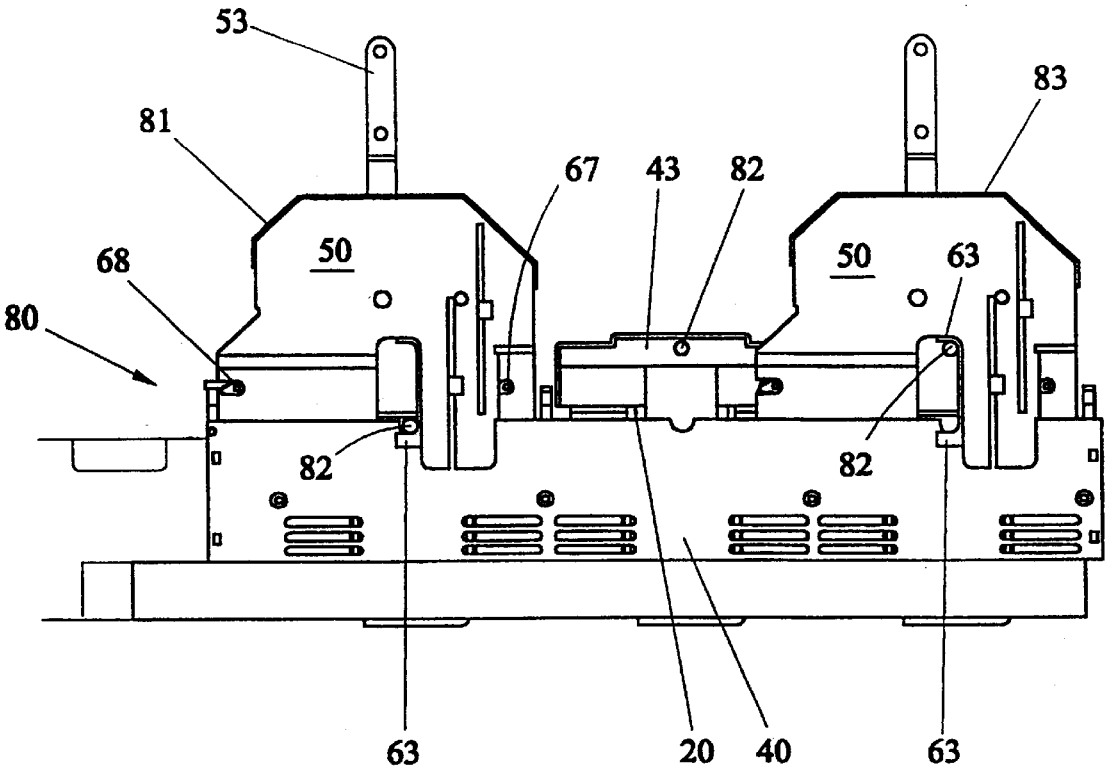
Figure 6C:
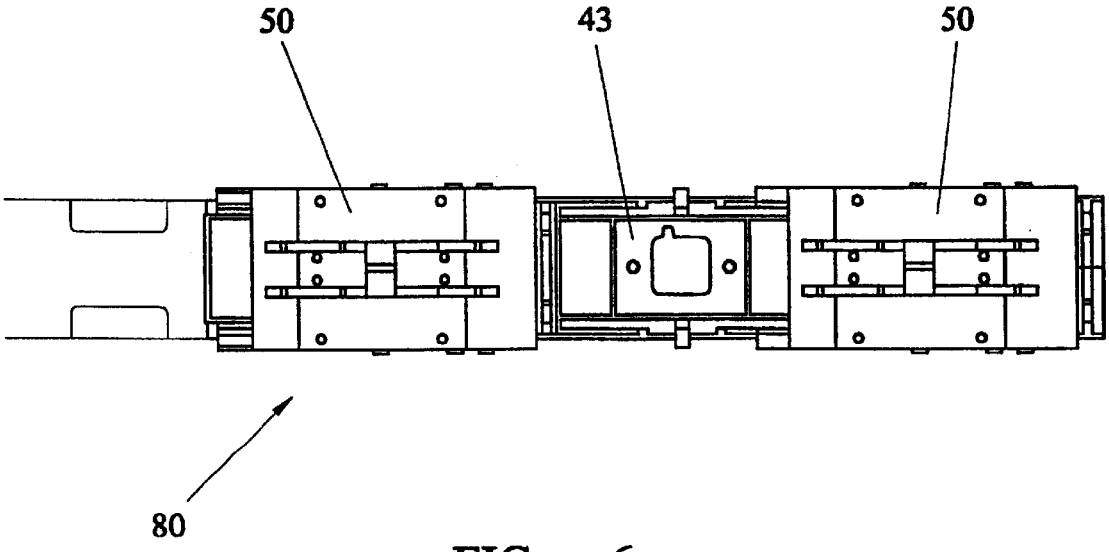

Use of a fuse handling device according to an aspect of the invention as part of a fuse assembly 80 according to a further aspect of the invention will now be described with reference to FIGS. 6*a*, 6*b* and 6*c*. The assembly 80 comprises a fuse handling device 50 mounted on a fuse unit 40. With the actuator lever in the neutral position as shown in FIGS. 6*a* and 6*b*, the fuse handling device is mounted on the fuse unit having European style fuses in fuse holders and extending between pairs of contacts. A handling device 81 is brought into correct registration with the fuse unit by engaging location formations 67, 68 with co-operating formations on the fuse unit. The fuse engagement formation 63 of the drive means of the handling device engages a co-operating formation 82 of a fuse holder 43. Pushing the lever 53 to the left, as shown in FIG. 6*b*, into a first operating position charges the springs 56, 57 by a predetermined extent after which the springs discharge the store energy to draw the sliding member into the housing thereby withdrawing the European style fuse from its pair of contacts of the live fuse unit so that it no longer bridges the contacts. The handling device may then be removed from the fuse unit leaving the fuse removed from the contacts, as per the middle fuse holder of FIG. 6*b*.

It will be appreciated that the direction of movement of the lever is relative to the orientation of the fuse unit. Hence if the fuse unit is vertically mounted, as is often the case, the lever will be actuated upward and downward so as to insert and withdraw the fuse.

A European style fuse may be safely inserted into a pair of live contacts of a fuse unit by operating actuating lever in the opposite direction. Fuse handling device 83 is mounted on the fuse unit over a fuse holder with the fuse removed from its pair of contacts and the lever in the neutral position. Operating the lever to the right, as shown in FIG. 6*b*, into the second operating position causes spring 57 to become charged to a predetermined extent. Having reached that extent of charging, the springs discharge the stored energy to cause sliding member 62 to move out of the housing whereby fuse engagement formation 63 engages co-operating fuse holder formation 82 driving the fuse housing and European style fuse therein into the fuse unit, rapidly and safely engaging the contact members of the European style fuse into its pair of contacts of the fuse holder thereby bridging the European style fuse across the pair of contacts.

A further embodiment of a fuse handling device and fuse assembly will now be described with reference to FIGS. 7*a*, 7*b* & 7*c*, FIGS. 8*a*, 8*b* & 8*c* and FIG. 9.

Figure 8A:
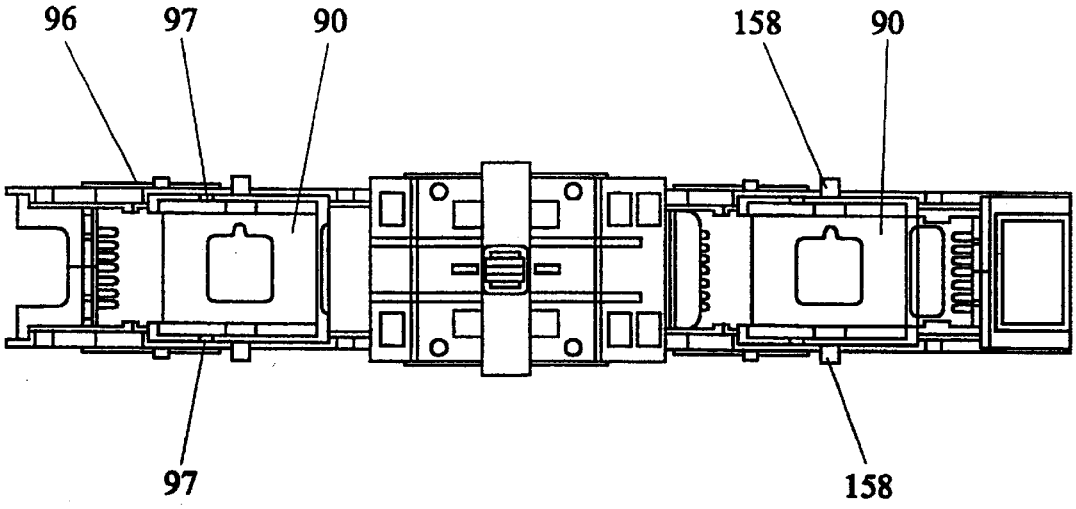
FIGS. 8*a*, 8*b* & 8*c* show plan, side and perspective views respectively of a further fuse assembly according to an aspect of the invention including the fuse handling device shown in FIG. 7 mounted in use on a fuse unit.
Figure 8B:
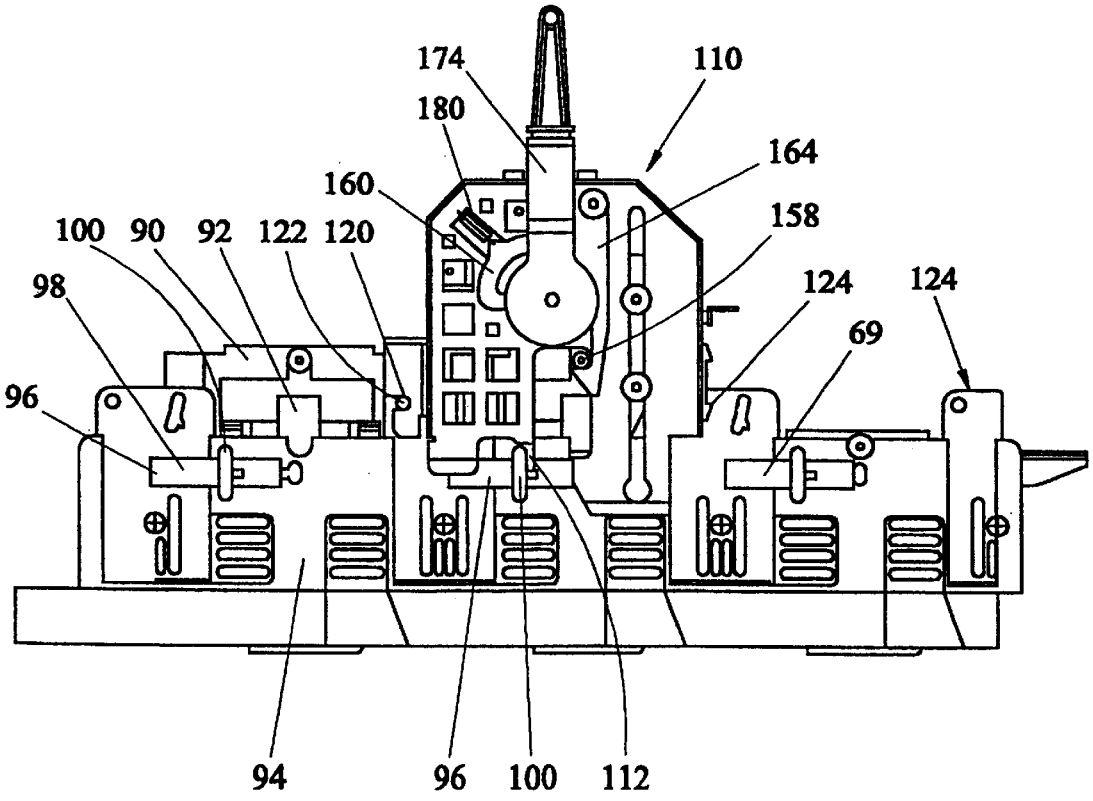
Figure 8C:
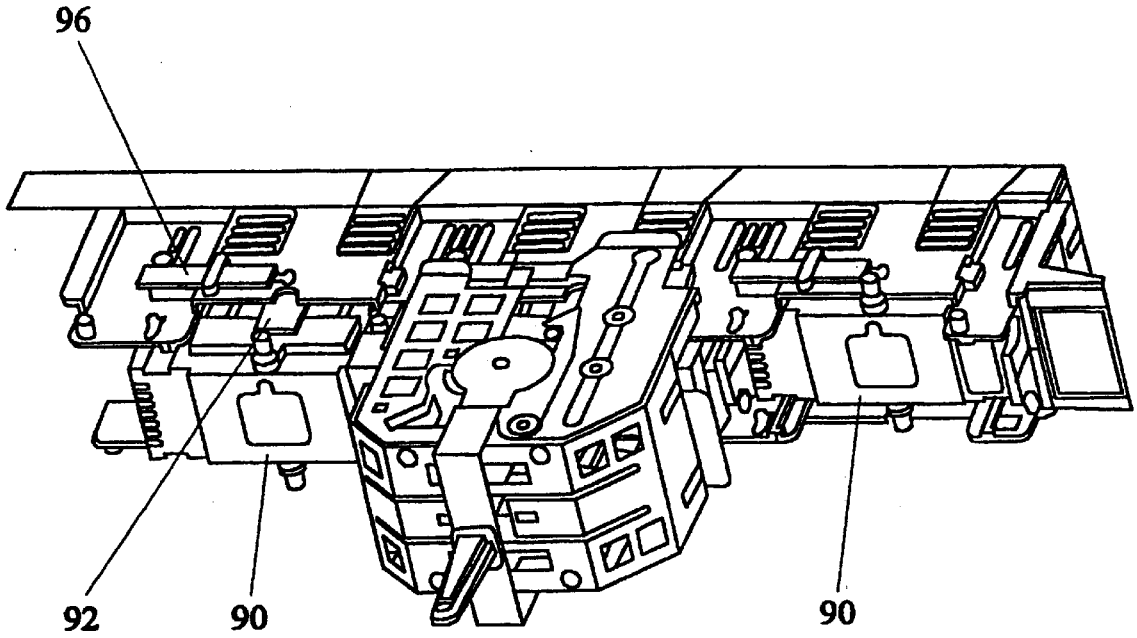

The use assembly as shown in FIGS. 8*a*, 8*b* and 8*c* includes a fuse carrier interlock mechanism. Each fuse carrier 90 carries within it a fuse. Both sides of the fuse carrier bears a camming formation 92. The camming formation is proud of the surface and provides an interlock formation thereon. The fuse unit, or fuse way, 94 includes an interlock mechanism 96 on each side and associated with each pair of contacts. Each interlock mechanism includes a stub 97 projecting internally to the fuse unit and toward the side of the fuse carrier. The interlock mechanism includes a housing and an operating member 100 slidably mounted in the housing and to which the stub 97 is attached. A spring is provided internally to the interlock mechanism to urge the sliding parts to the right as shown in FIG. 8*b*. In this position, the stub is engageable against a lower or an upper edge surface of the camming formation 92 so as to prevent motion of the fuse carrier into, or out from, the fuse unit once located therein.

The fuse handling device 110 includes a downwardly depending part 112 with a curved surface part positioned to engage and operate member 100 as will now be described. A similar part is provided on the other side of the handling device. With particular reference to FIG. 8*b*, the left most fuse carrier is prevented from insertion into the fuse unit by the action of stub 96 on the lower edge surface of camming formation 92. The right most fuse carrier is fully inserted in the fuse unit and prevented from being withdrawn by the action of stub 96 on the upper most surface of camming member 92.

The middle portion of the fuse assembly includes a fuse handling device mounted on the fuse unit. The curved surface of member 112 engages member 100 of the interlock mechanism sliding it and the attached stub sideways thereby preventing engagement of the stub and camming formations on the sides of the fuse carrier. Therefore the fuse carrier may now be withdrawn or inserted into the fuse unit. Two interlock mechanisms are provided one on each side of the fuse unit and corresponding interlock actuating members 112 are provided on the handling device. The fuse carrier interlock mechanism ensures that the fuse carrier is locked in either the inserted or withdrawn position when the handling device is removed to prevent unintentional removal or insertion of the fuse carrier.

Figure 7A:
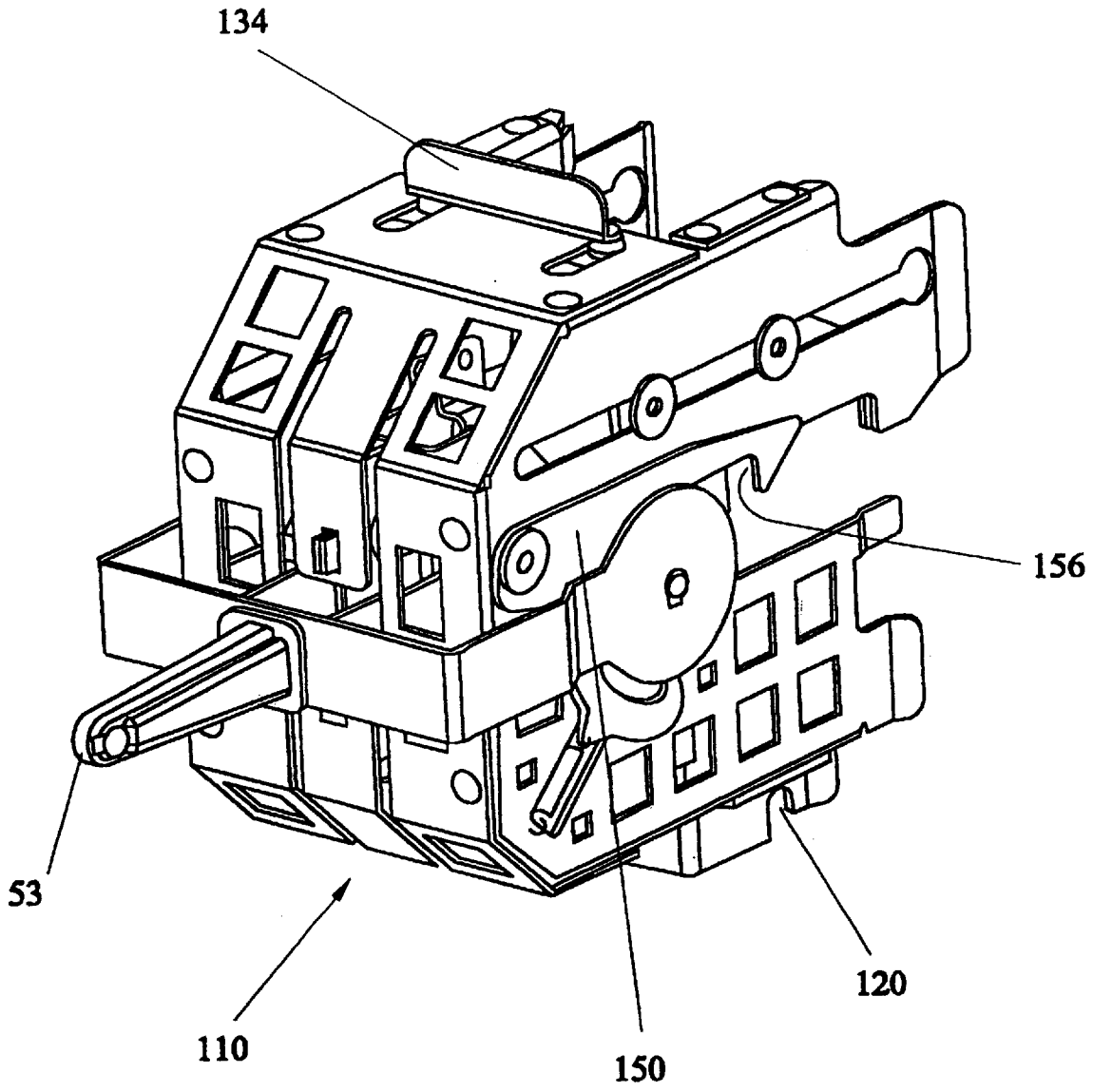
FIGS. 7*a*, 7*b* & 7*c* show perspective front and rear views, and an exploded view respectively of a further fuse handling device according to an aspect of the invention.
Figure 7B:
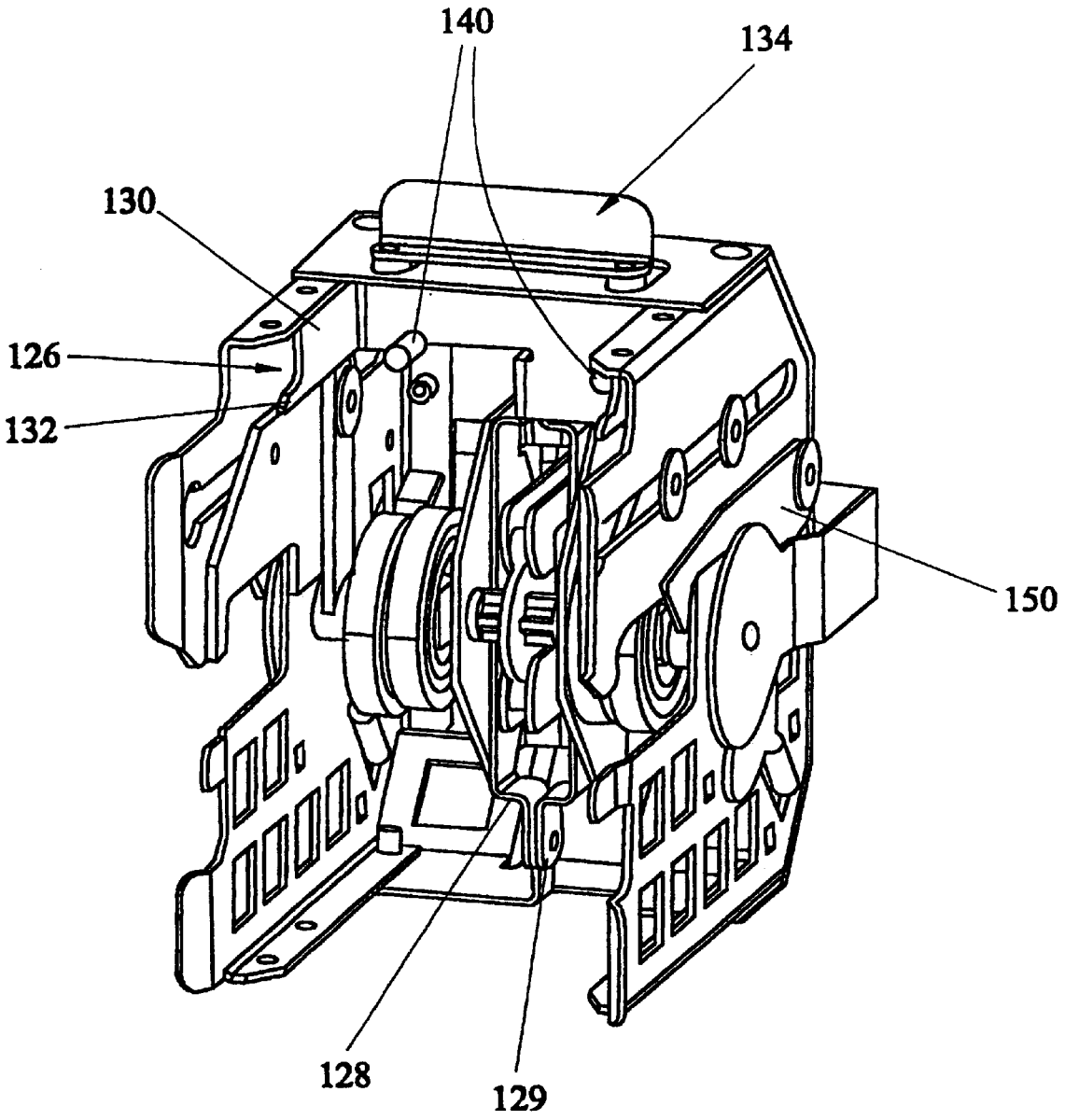
Figure 7C:
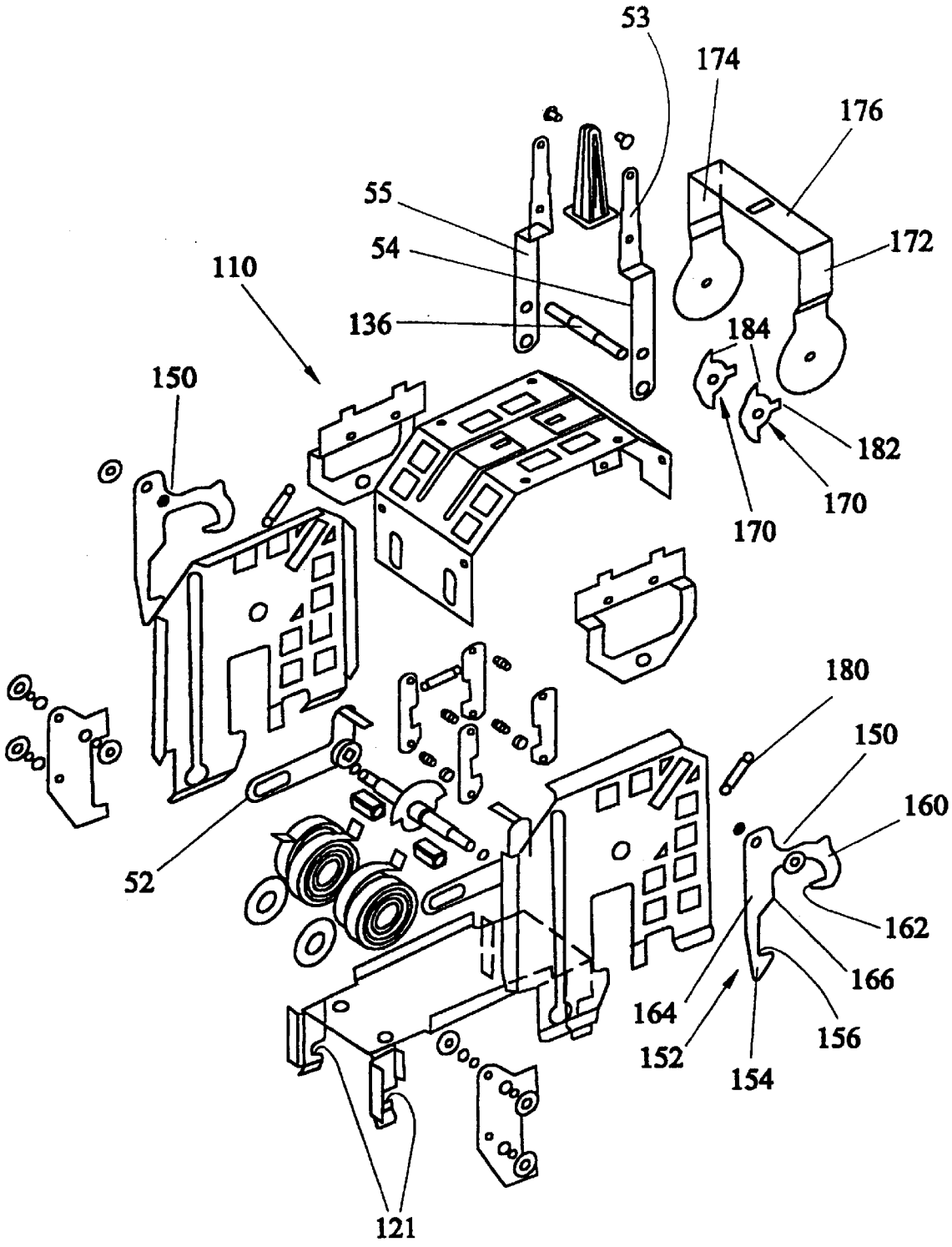
Figure 9:
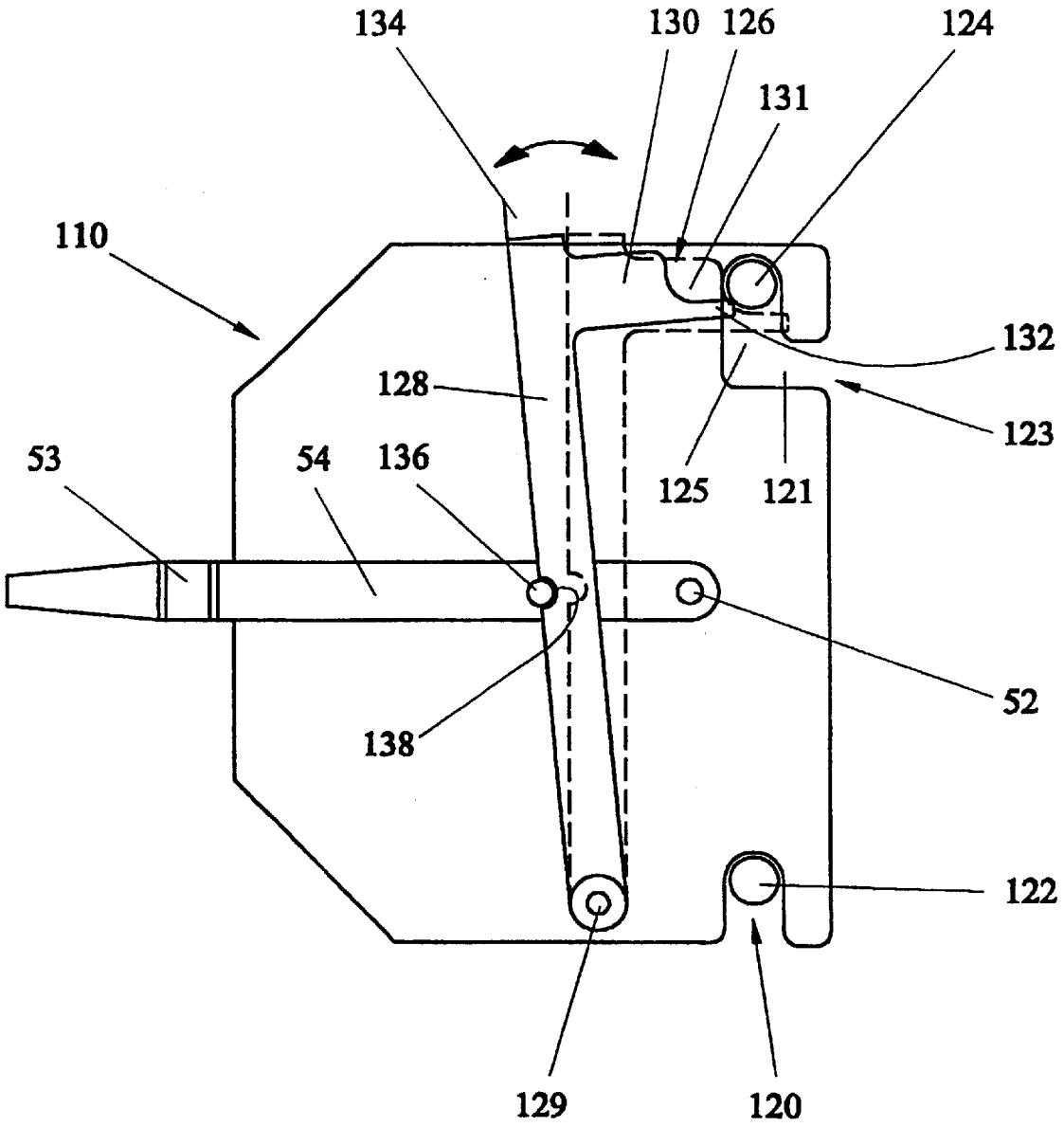
FIG. 9 shows a schematic sectional view of a fuse handling device illustrating an interlock feature.

A fuse handling device interlock is also provided to ensure that the fuse handling device 110 is correctly fitted to the fuse unit for operation. (The handling device interlock parts are not shown in FIG. 7*c* for sake of clarity.) With particular reference to FIGS. 7*a*, 7*b* and 9, the handling device interlock mechanism includes a notch 120 provided at a first end of the handling device housing, one on each side. The handling device housing also includes an engagement formation 121 at a second, forward end of the housing. Engagement formations are provided on each side of the housing. The engagement formation includes a mouth 123 leading to a recess portion 125, disposed substantially perpendicularly thereto. The fuse unit 94 is provided with a first, rearward locating and mounting formation in the form of a dowel 122. A second, forward mounting formation also in the form of a dowel 124 is also provided on the fuse unit. The forward locating and mounting formation associated with one pair of fuse contacts provides the rearward mounting and locating formation for the adjacent pair of fuse contacts. Equivalent mounting formations are provided on both sides of the fuse unit.

The fuse handling device 110 includes a forward interlock formation 126 moveable relative to the housing of the fuse handling device. The interlock mechanism includes an interlock lever 128 pivotally mounted toward the rearward end of the handling device at pivot point 129. An element 130 extending from the lever 128 includes a notch 131 at a free end thereof defined in co-operation with an extended limb 132. The interlock is movable between a first locking position shown in dashed lines and a second unlocked position shown in solid lines, by an exposed handle end 134. A shaft 136 extends between arms 55 and 54 of the actuating lever 53. Shaft 136 is substantially parallel to the pivoting axis of the main actuating lever 53. A notch 138 is provided in a top surface of the interlock lever 128 to co-operate with interlock shaft 136. The handling device interlock is operated by pivoting between an unlocked position and a locked position as will now be described.

The fuse handling device 110 is mounted on the fuse unit by presenting the fuse handler substantially perpendicularly to the fuse way and positioned such that the forward dowels 124 engage mouth 123 of the forward locating formations 121 and with the reward recess 120 above rearward dowel 122, as shown in FIG. 9. The handling device can then be slid upwardly as shown in FIG. 9 so that rear dowel 120 engages rear recess 122 and the forward dowel 124 is engaged in forward recess portion 125. With the interlock lever in the locked position, limb 132 prevents acceptance of forward dowel 124 in recess 125. A pair of springs 140 are provided to urge the interlock lever into the lock position.

The interlock lever is moved to the unlock position to allow the recesses of the handling device to be slidingly engaged with the locating dowels and thereby to be correctly located on the fuse unit. The interlock lever may only be moved to the unlocked position, if main actuating lever 53 is in the neutral position so that interlock shaft 136 can be accepted in notch 138. If the main actuating lever is not in the neutral position then interlock shaft 136 prevents movement of the interlock lever and mounting is thereby prevented.

With the actuating lever in the neutral position, the interlock lever is then placed in the locking position by interposing limb 132 between the forward and rearward dowels, thereby securing forward dowel 124 in recess 125 and preventing removal of the handling device from the fuse unit. Once in the lock position, the interlock shaft 136 and notch 138 are disengaged and the handling device may be actuated by actuating lever 53.

When the handling device is fitted and the interlock lever has been moved to the lock position, the handling device can be operated to insert or withdraw a fuse carrier. This interlock mechanism ensures that the fuse carrier cannot be inserted or withdrawn by the handling device unless the fuse handling device is correctly fitted and locked in place on the fuse unit.

The fuse handling device 110 also includes a mechanism for locking the fuse carrier in the handling device prior to insertion, or after removal, of the fuse carrier from the fuse unit. When a fuse carrier is located in the fuse unit, the pressure of the pair of electrical contacts ensures it remains in the fuse unit and the fuse carrier is not extracted unless the handling device is actuated. However, when the fuse carried is withdrawn from the fuse unit in the handling device, the light friction provided by the fuse carrier and its guides is not sufficient to ensure that the fuse carrier does not, under the influence of vibration or similar effects move to a partially closed and dangerous position in the fuse units.

In order to obviate these problems a fuse carrier locking mechanism is provided in the handling device 110. The handling device includes a pair of arms 150 pivotally mounted on either side of the handling device. A free end of each arm 152 has a hook shaped end 154 with a notch 156 defined by an inner edge surface thereof and a camming surface 155 provided by a lower edge thereof. Each fuse carrier 90 includes a pair of fuse carrier drive pegs 158 extending from either side thereof. These drive pegs provide a fuse carrier locking formation which can be selectively engaged in the recess 156 of pivotable arms 150. Drive pegs 158 are the same as the fuse carrier formations 82 discussed earlier.

Pivotable arms 150 include a second limb 160. The second limb 160 includes end face 162 and first limb 164 includes a second upper camming surface 166 which cooperates with a cam member 170. Cam members 170 are mounted on the legs 172 174 of a generally U shaped lever part 176 mounted on and operable by actuating lever 53. The legs of lever 176 are mounted on the ends of the main operating shaft 52. Cam member 170 includes first part 182 engageable with surface 162 of the pivot arm and a second camming part 184 engageable with edge surface 166 of the pivot arm. (The upper part of cam 170 symmetric to part 184 is not required for the operation of the pivotable arm and is a result of the machining of the cam 170.) Camming part 170 is fixedly mounted to the leg of lever part 176 and located between the first and second limbs of the pivotable arm 150. A spring 180 biasses the pivotable arm into a locking position in which the arm is directed substantially toward the fuse unit as shown in FIGS. 7*a* and 8*b*.

Operation of the fuse carrier locking mechanism will now be described. A fuse carrier is held in the fuse handling device and locked therein by drive pegs 158 being engaged in recesses 156 of respective pivotable arms 150. The actuating lever 53 is in the neutral position, as shown in FIG. 8*b*, and the shape of cam part 170 between the limbs of the pivotable arm prevents the pivotable arm from pivoting thereby locking the fuse carrier in the handling device. When the actuating lever 53 is pivoted to charge the main operating springs, cam 170 rotates and cam part 184 engages surface 166 to pivot arm 150 thereby releasing drive peg 158 from recess 156 immediately prior to the spring energy being released to insert the fuse carrier into the fuse unit. When the actuating lever is returned to the neutral position, spring 180 urges locking arm 150 back into the locking position and cam 170 rotates with the actuating lever to lock the locking arm in the locking position.

When a fuse carrier is withdrawn, the actuating lever is thrown in the opposite sense and cam 170 rotates such that formation 182 is disengaged from surface 162 thereby unlocking arm 150. When the fuse carrier is withdrawn under action of the main springs, pivot arms 150 are free to pivot as the fuse carrier formations 158 cam against lower camming surface 155 of the free end of the arms. Springs 180 bias the pivot arms 150 back into the locking position thereby engaging fuse carrier formations 158 in recesses 156 and locking the fuse carrier into the handling device. Returning the actuating lever to the neutral position re-engages part 182 of cam 170 with surface 162 of the second limb thereby locking the pivotable arms and preventing any further pivoting thereof.

Parts of the fuse handling device housing are cut away to reduce its overall weight.

It will be appreciated that providing a fuse handling device according to the invention allows for the safe handling of European style configured fuses in live three phase fuse units. The device is compact and capable of releasable mounting on a fuse unit, thereby allowing a single device to be used by an engineer working on a number of fuse units, and particularly suitable for cramped conditions. Obviating the need for an integral fuse handling device for a fuse unit also results in savings in cost and simplicity of fuse units. The interlock mechanisms enhance the safety of the handling device.

What is claimed is:

1. A fuse handling device for use with a fuse unit having a pair of contacts between which a fuse with integral switching contacts may extend in use, the handling device having an actuating lever operable into a first position and a second position, a charging means operably connected to the actuating lever and a drive means operably connected to the charging means, in which when the handling device in use is mounted on the fuse unit, the drive means attaches to the fuse and operation of the actuating lever into the first position charges the charging means to causes the drive means to extract the fuse from the pair of contacts and operation of the actuating lever into the second position charges the charging means to cause the drive means to insert the fuse into the pair of contacts, in which the fuse moves in a direction parallel to a plane of its switching contacts.

2. A device as claimed in claim 1, in which the device has a housing and an axle extending across the housing and the actuating lever pivots about the axle.

3. A device as claimed in claim 1, in which the drive means includes a member having a fuse engagement formation slidingly mounted on the device.

4. A device as claimed in claim 3, in which the member slides in a direction parallel to a plane defined by the pair of contacts of the fuse unit.

5. A device as claimed in claim 1, in which the charging means includes a pair of springs.

6. A device as claimed in claim 1, in which the charging means includes two pairs of springs.

7. A device as claimed in claim 5, in which the springs of a pair are wound in opposite senses.

8. A device as claimed in claim 2, in which the springs are mounted concentric to the axle.

9. A device as claimed in claim 8, in which an outer end of the first spring of the pair is connected to the actuating lever and an outer end of the second spring of the pair is connected to the drive means and the inner ends of the first and second springs are connected in series.

10. A device as claimed in claim 9, in which the pair of springs is connected in series via a square shaft mounted concentric to the axle.

11. A device as claimed in claim 2, in which a motion transformation device is mounted on the axle and engages the drive means.

12. A device as claimed in claim 2, in which the housing has locating formations which when the device is in use co-operates with the fuse unit to locate the device on the fuse unit.

13. A fuse assembly as claimed in claim 1, the fuse unit having three pairs of contacts between each of which a fuse having integral switching contacts may extend in use.

14. A fuse assembly as claimed in claim 1, in which the pair of contacts define a plane and the device in use moves the fuse substantially parallel to the plane.

15. A fuse assembly as claimed in claim 1, and including a fuse carrier interlock mechanism, the fuse having a carrier bearing an interlock formation on a side thereof, the fuse unit including an interlock mechanism including a projection directed toward the interlock formation, and engageable therewith to prevent motion of the fuse.carrier relative to the fuse unit, and the handling device including an interlock actuating member which, in use, operates the interlock mechanism to disengage the projection and interlock formation so as to allow the fuse carrier to be extracted from or inserted into the fuse unit.

16. A fuse handling device as claimed in claim 1 including a handling device interlock and for use with a fuse unit including a rear and a forward locating formation, the handling device including a notch engageable with the rear locating formation and a recess engageable with the forward locating formation, to allow the handling device to be slidably mounted on the fuse unit, and an interlock formation movable relative to the handling device and including a limb which when the forward locating formation is engaged in the recess is positionable between the rear and forward locating formations, to prevent relative sliding motion of the handling device and fuse unit thereby locking the handling device to the fuse unit.

17. A fuse handling device as claimed in claim 16, in which the handling device includes an interlock lever on which the interlock formation is mounted so as to be movable between a locked and an unlocked position.

18. A fuse handling device as claimed in claim 17, in which the interlock lever includes a part engageable with a part of the actuating lever to prevent operation of the actuating lever unless the interlock lever is in its locked position.

19. A fuse handling device as claimed in claim 18, in which the interlock lever part is a notch and the actuating lever part is an member extending parallel to the pivot axis of the actuating lever.

20. A fuse handling device as claimed in claim 1 for use with a fuse carrier having a fuse carrier locking formation, the handling device including a pivotable arm with a notch at a free end which in use is engageable with the fuse carrier locking formation so as to selectively lock the fuse carrier to the fuse handling device, a cam drivable by the actuating lever and acting on the pivotable arm such that when the actuating lever is in a neutral position, the arm cannot pivot thereby locking the fuse carrier to the fuse handler.

21. A fuse handling device as claimed in claim 20, and including resilient biassing means which biases the pivotable arm into a locking position.

22. A fuse handling device as claimed in claim 20, in which the cam includes a first part and a second part which when driven by the actuating lever to act on the pivotable arm allow the arm to pivot thereby allowing engagement or disengagement of the notch and locking formation.

23. A device as claimed in claim 2, in which the springs are mounted concentric to the axle.

24. A device as claimed in claim 2, in which the springs are mounted concentric to the axle.

* * * * *